US005090175A

United States Patent [19]

Arfert et al.

[11] Patent Number: 5,090,175

[45] Date of Patent: Feb. 25, 1992

[54] FREEZER APPARATUS

[75] Inventors: Horst F. Arfert, Midlothian; Roger H. Donaldson, White Stone; Thomas K. Murdock, Chester; Barry M. Whitlock, Richmond, all of Va.

[73] Assignee: Eskimo Pie Corporation, Richmond, Va.

[21] Appl. No.: 522,799

[22] Filed: May 14, 1990

[51] Int. Cl.[5] ..... E04B 2/38

[52] U.S. Cl. ..... 52/309.11; 52/309.9; 52/469; 52/807

[58] Field of Search ..... 52/309.11, 459, 461, 52/463, 469, 309.8, 309.9, 807, 817, 818, 573, 465

[56] References Cited

U.S. PATENT DOCUMENTS

| | | | |
|---|---|---|---|
| 1,940,277 | 12/1933 | Stresau | 196/133 |
| 2,321,589 | 6/1943 | Erland Af Kleen | 220/9 |
| 2,911,125 | 11/1959 | Dosker | 220/11 |
| 3,058,551 | 10/1962 | Martin | 52/573 |
| 3,331,173 | 7/1963 | Elsner | 52/807 |
| 3,341,051 | 9/1967 | Forman et al. | 220/9 |
| 3,570,702 | 3/1971 | Yamamoto | 220/16 |
| 4,050,009 | 9/1977 | Okamoto et al. | 220/9 LG |
| 4,481,747 | 11/1984 | Tengesdal et al. | 52/461 |
| 4,498,713 | 2/1985 | Fellwock et al. | 312/214 |
| 4,556,592 | 12/1985 | Bannink, Sr. | 428/45 |

FOREIGN PATENT DOCUMENTS 133177 10/1902 Fed. Rep. of Germany ..... 52/463

*Primary Examiner*—David A. Scherbel
*Assistant Examiner*—Robert Canfield
*Attorney, Agent, or Firm*—Nies, Kurz, Bergert & Tamburro

[57] ABSTRACT

A freezer having its walls constructed of spaced inner and outer stainless steel skins connected together by non-metallic, thermally non-conductive structural members having a configuration which greatly reduces the transfer of temperature extremes and thermal stresses between the skins. The structural members are preferably constructed of glass fibre and possess structural, thermal conduction, and thermal expansion properties which substantially reduce the transfer of heat and thermal stresses between the inner and outer skins as the freezer is subjected to temperature variations between normal processing temperatures of about −50° F. and heat sterilization temperatures up to 170° F. In addition, a novel expansion joint assembly includes a flexible resilient cover strip covering the joint areas of adjacent skins. The cover strip not only accommodates large thermal expansions and contractions between the skins but also provides for smooth, continuous surfaces having no exposed joints, fasteners or other discontinuities around which bacteria may accumulate and grow.

5 Claims, 4 Drawing Sheets

FREEZER APPARATUS

BACKGROUND OF THE INVENTION

This invention relates generally to industrial freezers and more particularly to a novel construction of the walls of industrial freezers used in manufacturing frozen dairy products such as ice cream bars.

Typically, industrial freezers of the type with which the invention is concerned are constructed as rectangular boxes, the walls of which have inner and outer stainless steel metal panels or skins separated by metal structural members and insulation. The skins and metal structural members are usually fastened together by way of metal fasteners and/or welding techniques.

Recent outbreaks of bacteria caused illnesses have motivated the dairy/ice cream industry to reexamine the design of freezers with an eye toward minimizing the potential for bacterial growth and eliminating such bacterial growth should it occur through frequent heat sterilization of the freezer components. Prior freezers were confronted with two problems. First, it was discovered that there was a propensity of bacteria to multiply and grow in the vicinity of joints, fasteners and other surface discontinuities. Second, the freezer components, particularly the wall structures, were subjected to increased thermal stress caused by cycling the freezer between its normal processing temperature of about −50° F. and the necessary sterilization temperature of about 170° F. Thus, it became readily apparent that prior conventional freezers could not maintain their structural integrity under the increased thermal stress conditions created by frequent sterilization necessary to avoid bacterial growth.

SUMMARY OF THE INVENTION

Accordingly, the primary object of this invention is to provide a novel industrial freezer constructed to minimize the potential for bacterial growth and capable of withstanding increased thermal stress loads created by frequent heat sterilization to eliminate such bacterial growth should it occur.

Another object of the invention is to provide the novel freezer as above wherein each wall of the freezer is constructed in such a way that its inner and outer skins are smooth and continuously welded and have no exposed joints, fasteners or other discontinuities around which bacteria may accumulate and grow.

Still another object of the invention is to provide the above novel freezer having its walls constructed of spaced inner and outer skins connected together by thermally nonconductive structural members which greatly reduce the transfer of temperature extremes and thermal stresses between the skins.

A further object of the invention is to provide the above novel freezer wherein the thermally non-conductive structural members are constructed of glass fibre and possess structural, thermal conduction, and thermal expansion properties which substantially reduce the transfer of heat and thermal stresses between the inner and outer skins as the freezer components are subjected to temperature variations between the processing temperature of about −50° F. and the sterilization temperature up to 170° F.

Still another object of the invention is to provide the above novel freezer wherein each of its walls is constructed from modular wall units arranged side-by-side, with a novel expansion joint assembly provided between adjacent wall units to permit the inner and outer skins of the wall units to expand and contract without harming the structural integrity of the freezer.

Another object of the invention is to provide the above novel expansion joint assembly which includes an offset flexible resilient cover strip covering the joint areas of the inner and outer skins of adjacent wall units.

A further object of the invention is to provide the above novel expansion joint assembly wherein the cover strip is constructed to accommodate large thermal expansions and contractions of the wall units and thereby avoid subjecting the wall units to the high tensile and/or compressive stresses which normally accompany expansion and contraction.

These and other objects of the invention will become more readily apparent from reading the following detailed description of the invention wherein reference is made to the accompanying drawings.

DETAILED DESCRIPTION OF THE INVENTION

Figure 1:
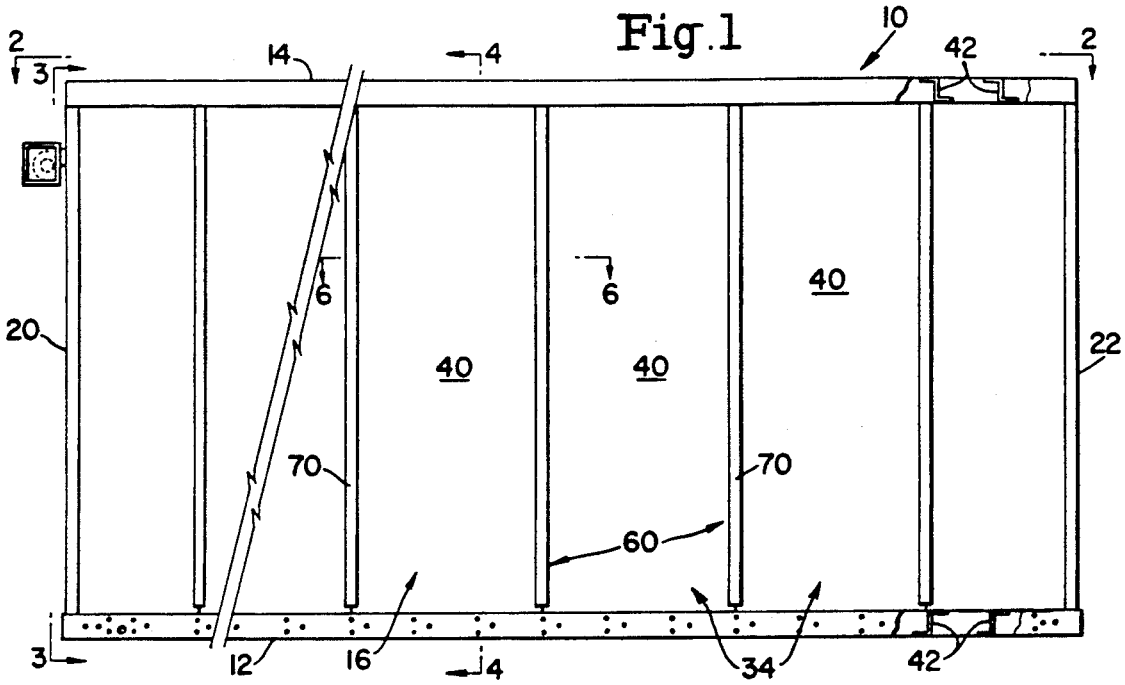
FIG. 1 is a partially sectioned fragmentary side view of a freezer box constructed according to the invention.
Figure 2:
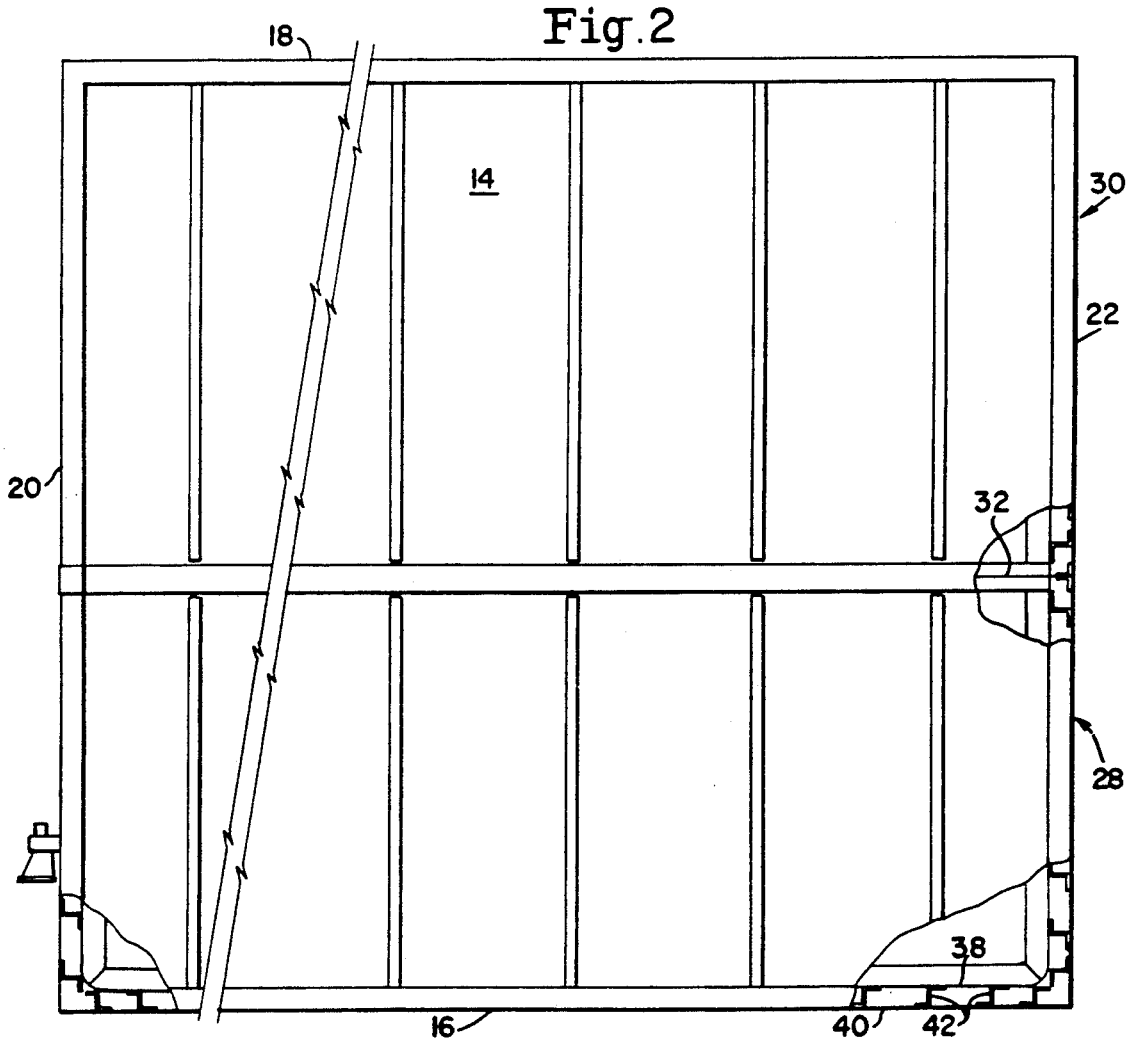
FIG. 2 is a partially sectioned fragmentary plan view of the freezer box taken along line 2—2 of FIG. 1.
Figure 3:
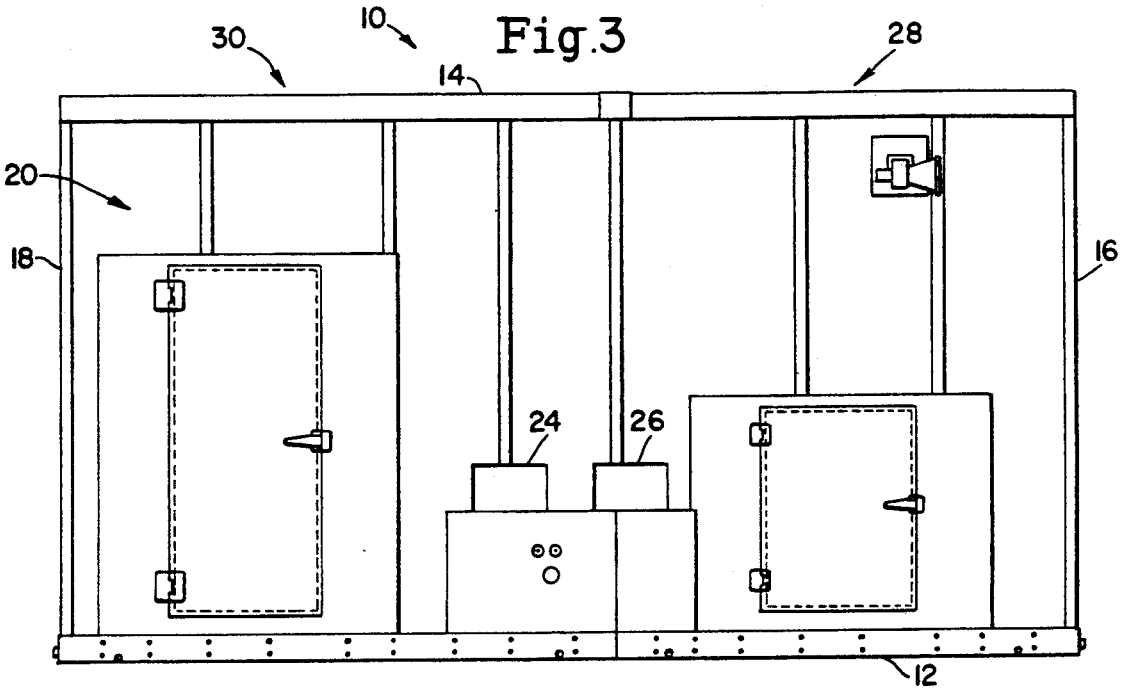
FIG. 3 is a fragmentary front view of the freezer box taken along line 3—3 of FIG. 1.
Figure 5:
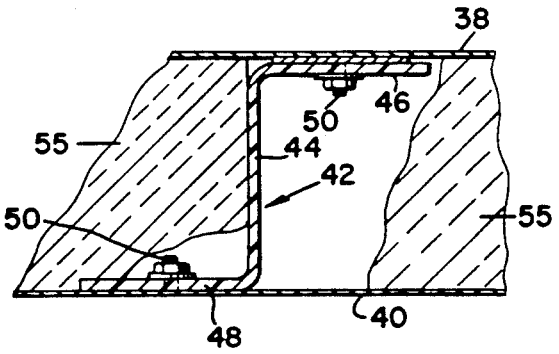
FIG. 5 is a fragmentary sectional view taken along line 5—5 of FIG. 4.

Referring now to FIGS. 1-3, the novel rectangular freezer box 10 includes main freezer chamber 11 formed by floor 12, ceiling 14, side walls 16 and 18, front wall 20, and rear wall 22. Box 10 includes the usual refrigeration equipment (not shown) for cooling its interior to about −50° F. and the usual conveyor equipment (not shown) for carrying food products to be frozen such as ice cream bars into and out of chamber 11 by way of entry opening 24 and exit opening 26 in front wall 20.

For shipping purposes, box 10 is constructed in two sections 28 and 30 which are joined together along separation line 32 at the plant site.

The walls, ceiling, and floor of box 10 all include spaced inner and outer metal panels or skins, formed e.g. from 18 gauge stainless steel sheets four feet wide, separated by non-metallic, thermally non-conductive structural members, e.g. glass fibre members generally Z-shaped in cross section, the space between the skins being filled with rigid foam thermal insulation.

Figure 6:
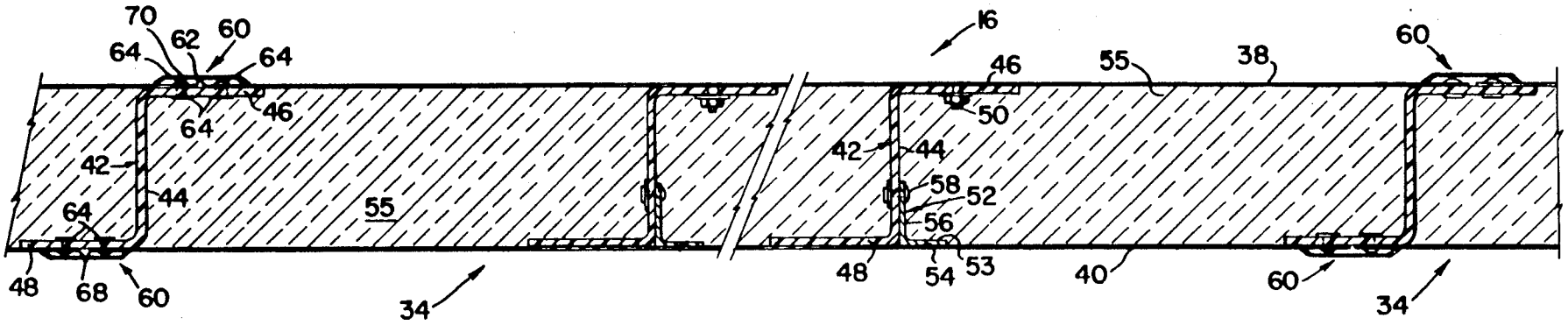
FIG. 6 is a fragmentary sectional view taken along line 6—6 of FIG. 1.

The construction of wall 16 is typical and will be described with particular reference to FIGS. 4 and 6. Wall 16 is formed by a plurality of side-by-side modular wall units 34 each of which includes spaced inner and outer skins 38 and 40, respectively, constructed of 18 gauge stainless steel sheets four feet wide, the exposed faces of inner skins 38 defining chamber 11. Skins 38 and 40 are connected together by a plurality of elongated non-metallic, thermally non-conductive glass fibre structural members 42 which extend substantially from top to bottom of the units. The space between panels 38 and 40 is filled with rigid foam thermal insulation 55. Each member 42 includes an elongated web 44 and flanges 46 and 48 extending perpendicular to and in opposite directions from opposite ends of web 44. Members 42 are spaced laterally about every sixteen inches along units 34. Flange 46 of each member 42 is connected to the inside unexposed face of skin 38 by a plurality of vertically spaced threaded studs 50 which are spot welded on the inside face of skin 38. A vertical hot rolled steel angel iron member 52 has one leg 53 spot welded at a plurality of vertically spaced locations 54 to the inside unexposed face of skin 40 and its other leg 56 connected to web 44 by way of vertically spaced rivets 58.

Figure 8:
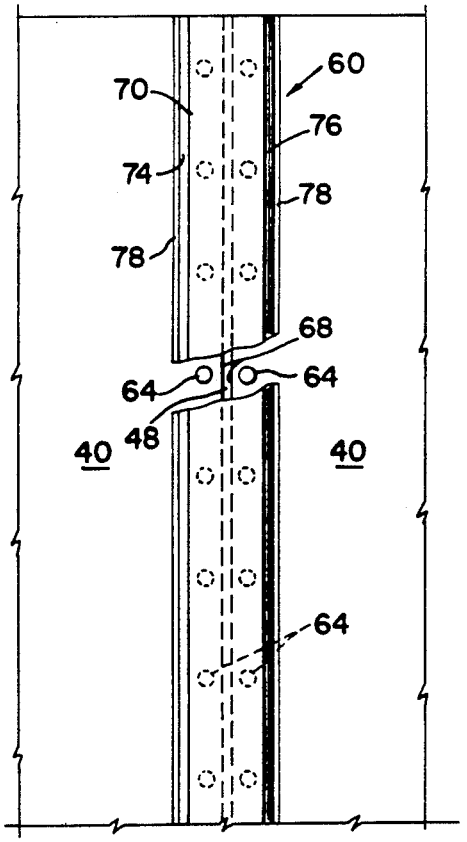
FIG. 8 is a fragmentary sectional view taken along line 8—8 of FIG. 7.
Figure 7:
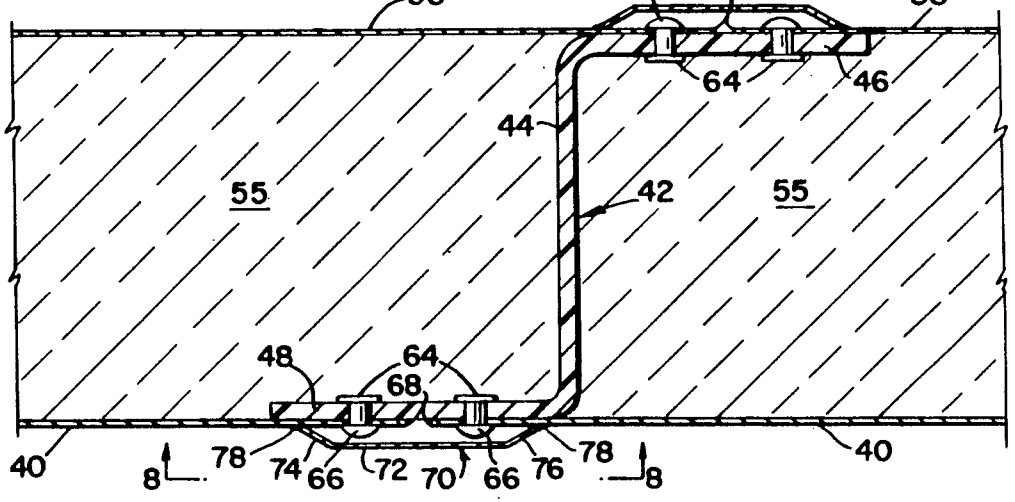
FIG. 7 is an enlarged fragmentary plan view illustrating the novel expansion seal joint of the invention.

A novel expansion joint assembly 60 (FIGS. 7 and 8) is provided between adjacent wall units 34 and includes a member 42 whose flange 46 spans the joint between the opposed spaced edges 62 of adjacent inner skins 38 which are connected to flange 46 by way of suitable fasteners such as rivets 64, the heads 66 of which engage against the exposed face of skins 38. Similarly, flange 48 spans the joint between the opposed spaced edges 68 of adjacent outer skins 40 which are connected to flange 48 by way of rivets 64 whose heads engage against the exposed faces of skins 40. A resilient cover strip 70 of 18 gauge stainless steel material extends substantially the full vertical height of skins 38 and 40 on their exposed faces and fully covers the joint areas of adjacent skins 38 and adjacent skins 40. Cover 70 has a generally outwardly bowed configuration and includes a substantially flat center section 72 spaced from the skins and inwardly bent end sections 74 and 76 whose edges engage against and are continuously seal welded to the skins along weld lines 78. Cover 72 totally encloses the spaced edges of the skins and the fasteners 64, and the weld lines 78 are ground smooth to eliminate surface discontinuities in the joint areas of the skins.

Walls 18, 20 and 22 are constructed the same as wall 16 with members 42 extending vertically. In floor 12 and ceiling 14 the members 42 extend horizontally between side walls 16 and 18 as shown in FIGS. 1, 2, 4, and 5. Their flanges 46 and 48 are connected to skins 38 and 40 via studs 50 which are spot welded to the inside face of the skins.

From the description hereinabove, it is apparent that the exposed faces of skins 38 and 40 and cover strips 70 are smooth throughout to avoid the collection of foreign material thereby minimizing the potential for bacterial growth. In addition, because the walls include the thermally non-conductive structural members 42, the foam insulation 55, and the novel joint assembly 60, the freezer can be heat sterilized frequently to avoid bacterial growth without structurally damaging the freezer components. In particular, even though the freezer is normally subjected to processing temperatures as low as −50° F. and then periodically subjected to sterilization temperatures up to 170° F., the structural integrity of the freezer is maintained because of the thermal insulating characteristics of the foam 55 and members 42 and also because of the flexibility and resiliency of members 42, the bowed configuration and resiliency of cover strips 70, and the spacing between the opposed edges of adjacent skins at each joint assembly 60.

The configuration of each glass fibre structural element 42 enables the element to bend and flex as necessary to absorb any thermal stresses created in skins 38 and 40 as the temperature varies between the processing temperature of −50° F. and the sanitizing temperature of 170° F. Because flanges 46 and 48 extend in opposite directions from web 44, member 42 conveniently reduces the transmission of those thermal stresses between skins 38 and 40 as the skins expand and contract under the different temperature conditions.

Similarly, the offset or bowed configuration of cover strip 70 permits the strip to flex under different thermal stress conditions without breaking any of the welds 78.

Likewise, the spacing between opposed edges 62 of adjacent inner skins 38 and opposed edges 68 of outer skins 40 avoids interference between the skins as they expand and contract.

Figure 4:
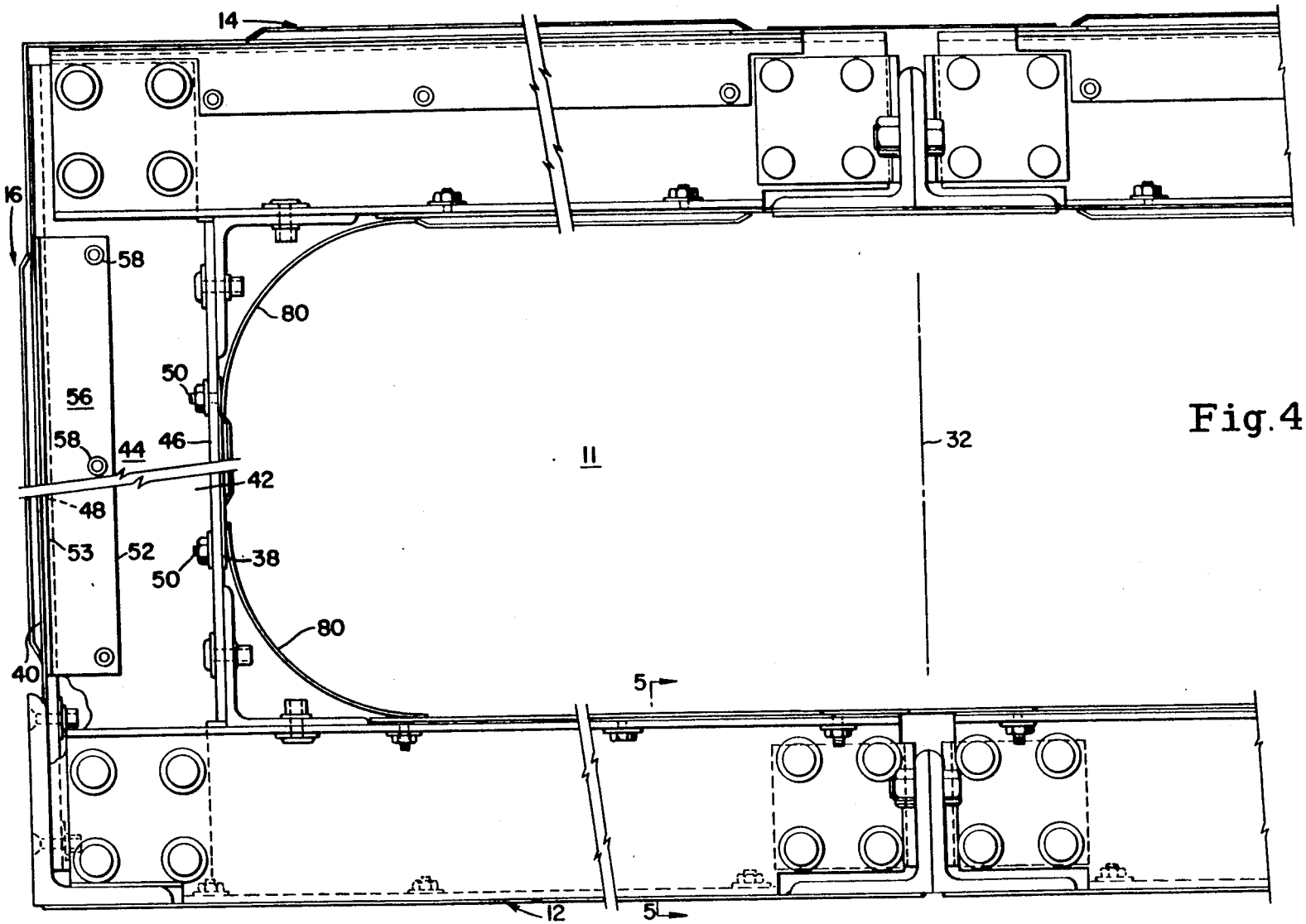
FIG. 4 is a fragmentary sectional elevation view taken along line 4—4 of FIG. 1.

To further enhance the ability of the freezer cavity to avoid the build-up of bacteria and for ease of sanitizing, as shown in FIG. 4 at each corner of chamber 11 a rolled stainless sheet 80 is welded in place to isolate the usual carbon steel structural elements and the fasteners from the working area of the chamber.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. Freezing apparatus having wall means defining a freezing chamber, said wall means being formed by a plurality of adjacent wall units arranged side by side and adjoining each other at a joint area, each of said wall units including spaced inner and outer skins and a plurality of non-metallic, thermally non-conductive, flexible, generally Zshaped structural members mounted between and extending along said skins, each of said structural members including an elongated web section, first flange means extending laterally from one end of said web section in one direction and connected to said inner skins and second flange means extending laterally from the other end of said web section in an opposite direction and connected to said outer skins, opposed edges of adjacent inner skins being spaced from each other, one of said structural members being located at the joint area of adjacent wall units having its first flange means connected to and spanning the joint area of adjacent inner skins and its second flange means connected to and spanning the joint area of adjacent outer skins of adjacent wall units, resilient cover means extending along said adjacent inner skins covering said joint area, and thermal insulation means mounted between said skins.

2. Freezing apparatus according to claim 1, comprising first fastener means connecting one of said adjacent inner skins to said first flange means and second fastener means connecting the other of said adjacent inner skins to said first flange means, said cover means being connected to said adjacent inner skins at locations laterally beyond said fastener means so as to cover said fastener means.

3. Freezing apparatus according to claim 2, said cover means comprising resilient strip means having a center section spaced away from said skins and end sections bowed inwardly toward and secured to said skins.

4. Freezing apparatus according to claim 3, wherein said end sections are continuously welded to said skins.

5. Freezing apparatus according to claim 1, wherein said structural members are of glass fibre construction.

* * * * *